United States Patent [19]

Kogelmann

[11] 4,133,582

[45] Jan. 9, 1979

[54] LOW PROFILE MINING MACHINE

[76] Inventor: Wilhelm J. Kogelmann, R.D. #1, Box 255-C, Boalsburg, Pa. 16827

[21] Appl. No.: 843,221

[22] Filed: Oct. 18, 1977

[51] Int. Cl.[2] ..... E21C 27/24

[52] U.S. Cl. ..... 299/64; 173/29; 299/75

[58] Field of Search ..... 299/64, 75, 76, 90, 299/85; 175/91; 173/29; 30/500

[56] References Cited

U.S. PATENT DOCUMENTS

| | | | |
|---|---|---|---|
| 678,045 | 7/1901 | Seltner | 175/91 X |
| 2,263,925 | 11/1941 | Jeffrey et al. | 299/72 |
| 2,619,339 | 11/1952 | Cartlidge | 299/64 |
| 3,899,212 | 8/1975 | Sigott et al. | 299/75 |

FOREIGN PATENT DOCUMENTS

| | | | |
|---|---|---|---|
| 676059 | 7/1952 | United Kingdom | 299/85 |

*Primary Examiner*—Ernest R. Purser
*Attorney, Agent, or Firm*—Brady, O'Boyle & Gates

[57] ABSTRACT

To maintain the lowest possible machine profile between the bottoms of the crawler treads and the top of the turret, the boom of the machine and boom lifting cylinders are cantilevered forwardly of the turret and depressed to lie as closely as possible to the underlying gathering head of the machine without clogging the throat of the machine and/or interfering with the operation of the gathering arms. The boom pivot and boom lift cylinders are disposed ahead of the crawler treads and the connections of the boom lift cylinders with the turret are forwardly of the highest part of the gathering head. This geometry renders it possible to significantly lower the elevation of the machine turret on which the boom is mounted for sluing or swinging movement and thus minimize the total height or profile of the mining machine.

17 Claims, 11 Drawing Figures

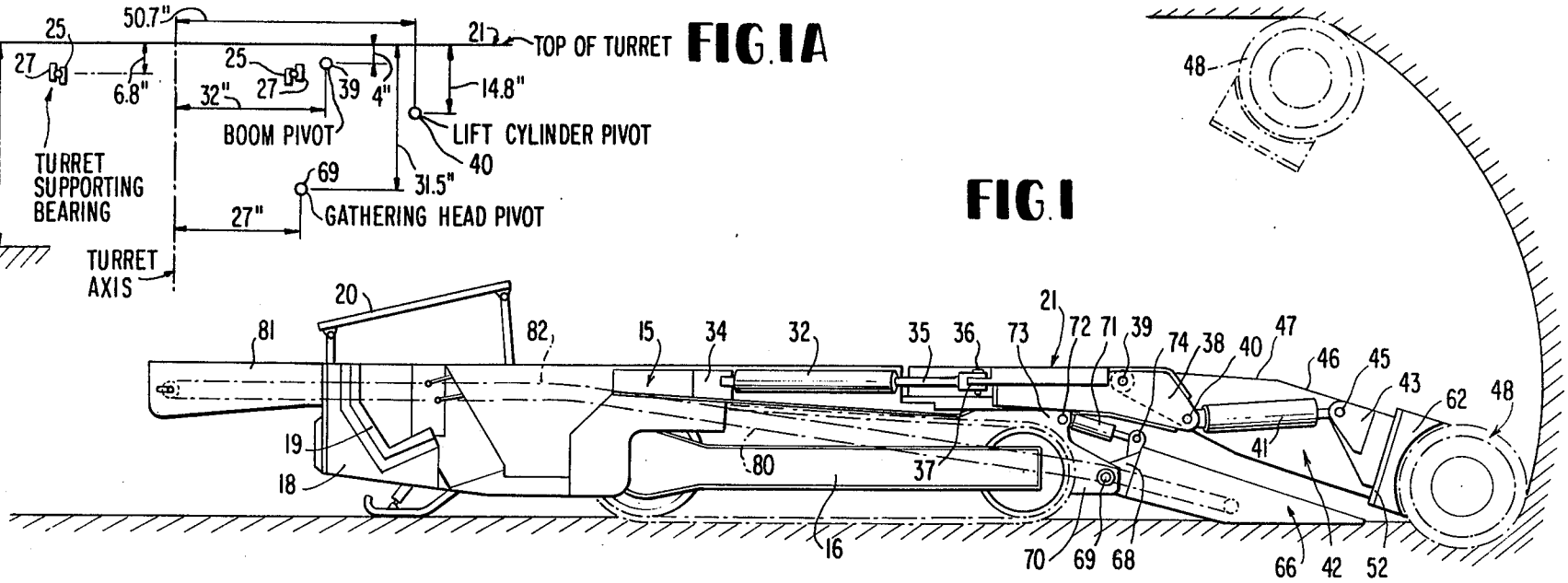
FIG. 1A
FIG. 1
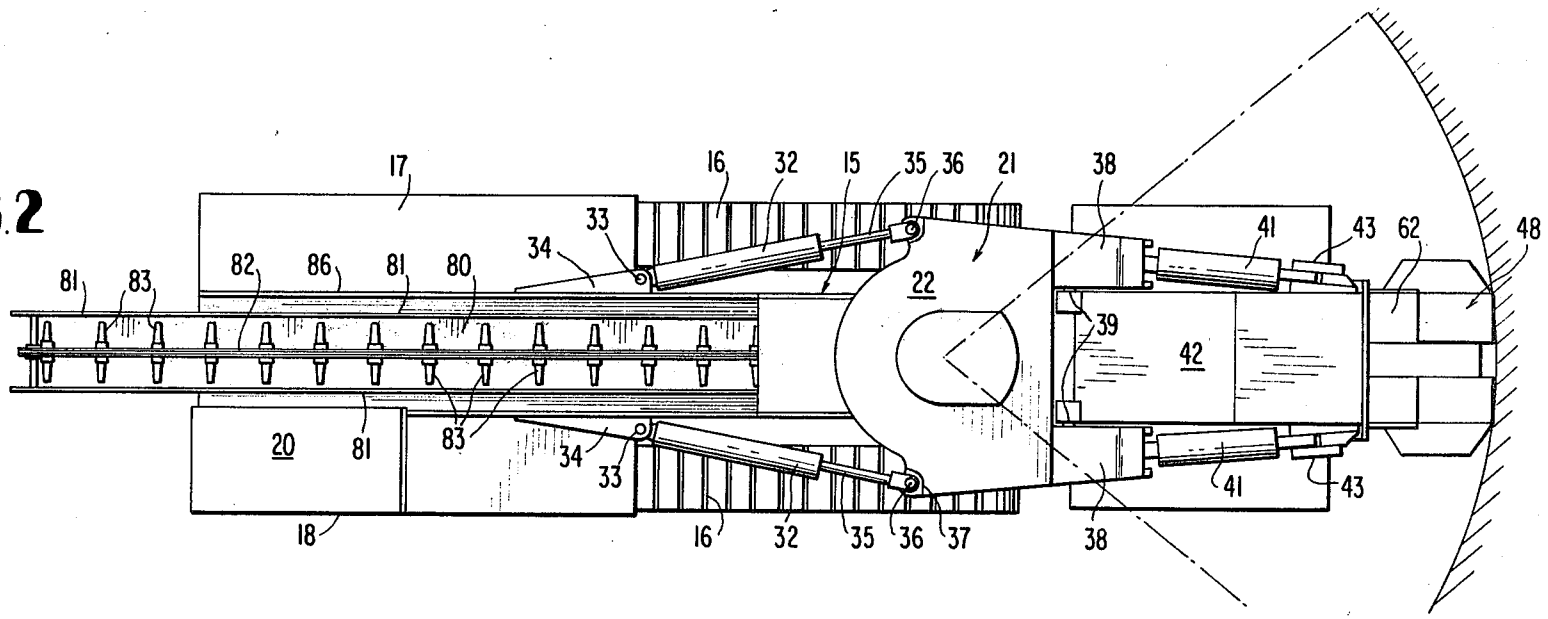
FIG. 2

FIG. 10
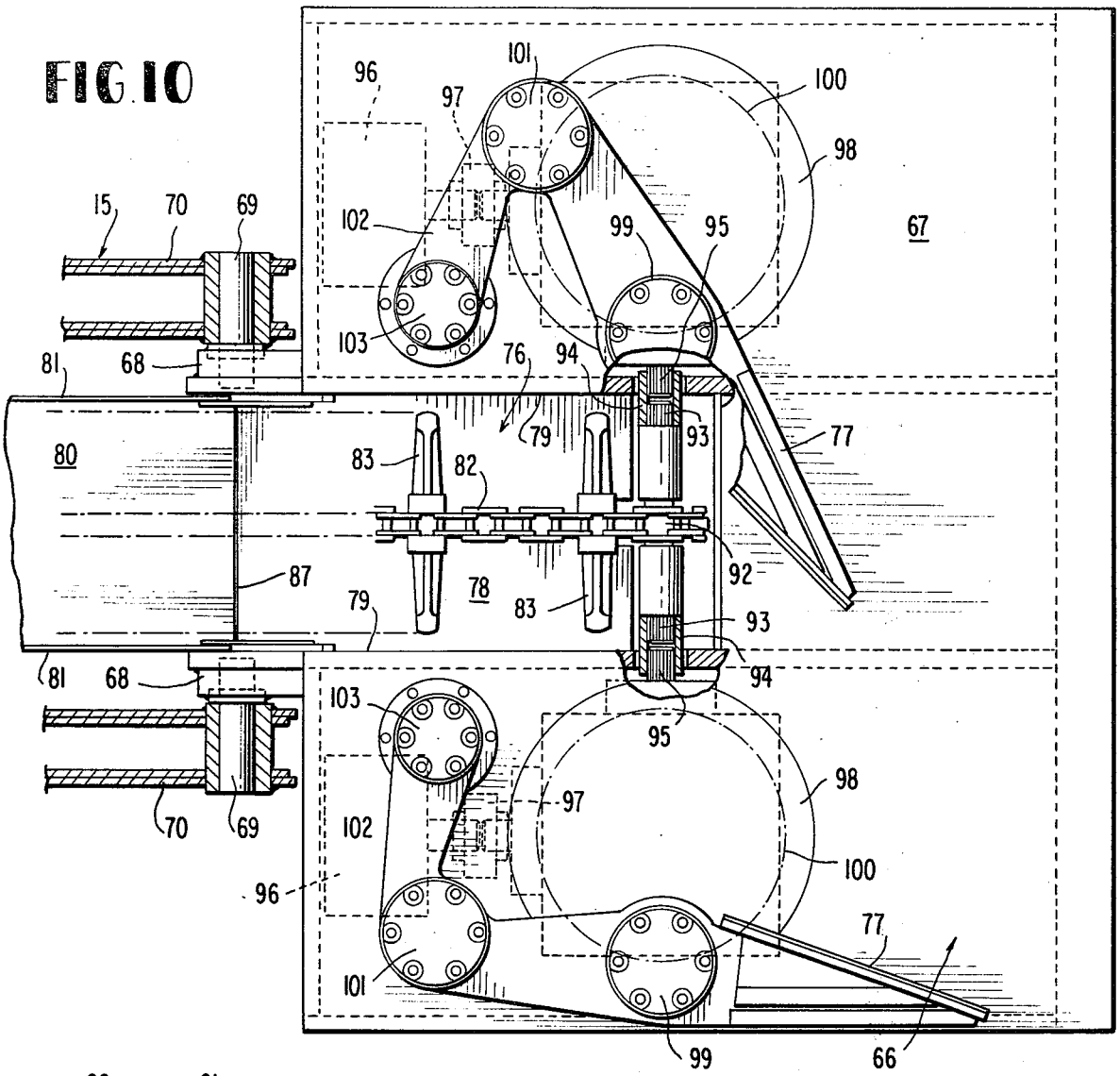
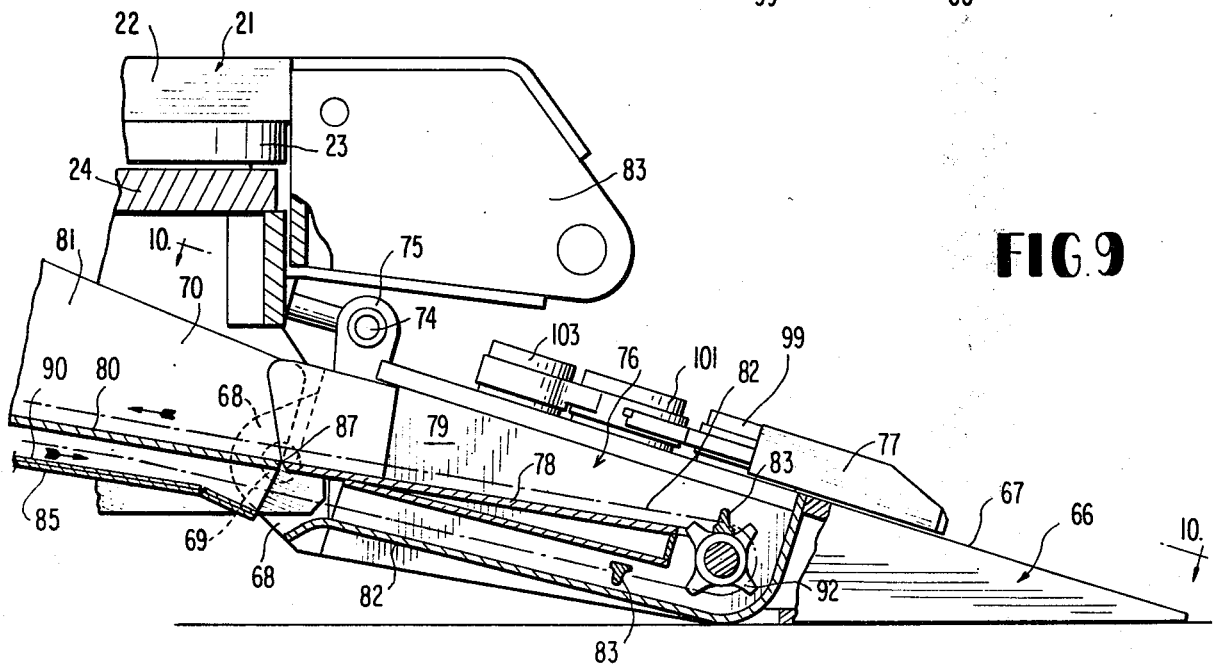
FIG. 9

LOW PROFILE MINING MACHINE

BACKGROUND OF THE DISCLOSURE

Domestic and foreign crawler type continuous mining machines are well known in the prior art. Some examples of the patented prior art are contained in U.S. Pat. Nos. 3,899,212 and 3,972,429.

The broad objective of the present invention is to provide a very low profile mining machine which is capable of moving into and throughout a mine fully assembled. Many present day mining machines, including imported machines, are so high when assembled that they have to be disassembled outside of a mine and transported, piece-by-piece, through the relatively low mine entrance passageway and reassembled in the mine tunnel. Some of the machines must be further disassembled and reassembled in order to move from one part of the mine to another. This is obviously a costly and laborious process, and it is the purpose of the present invention to substantially eliminate or greatly reduce this prior art problem.

Another important reason dictating the lowest possible height or profile overall for a mining machine is that increasingly shallow seams of coal and other minable solids are now being utilized, whereas in the past such shallow seams were ignored in the interest of mining much larger seams which have now been diminished to a great extent. It is therefore a question of economics which requires that mining machines be made increasingly lower and more compact without loss of stability, ruggedness and massiveness, which are essential requirements for a practical and efficient mining machine. More specifically, in explaining the desirability of a low profile mining machine, a mine entrance may measure four feet high by a mile or more long before reaching the main mine tunnel. In forming such an entranceway through hard rock in many cases, it is obviously much more economical to be able to minimize the height of the entranceway and this height will be determined by the height or profile of the mining machine which must form the passage and enter into the mine proper.

In essence, the present invention seeks to satisfy the above need of the art to a great extent, and the invention is believed to be a very significant advance in this respect over the prior art. Additionally, the low profile mining machine according to the invention loses none of its mobility, stability and massiveness because of its shape and possesses a mining boom which has a large swing and shear range during operation.

Other features and advantages of the invention will become apparent during the course of the following description.

BRIEF DESCRIPTION OF THE DRAWINGS

FIG. 1 is a side elevation of a low profile mining machine embodying the invention.

FIG. 1A is a schematic view depicting the locations of critical pivot points of machine components in relation to the top plane of the machine turret and to one another and to the turret support bearing.

FIG. 2 is a plan view of the mining machine.

FIG. 9 is a fragmentary side elevation, partly in section, of a gathering head and associated parts.

FIG. 10 is a cross section taken on line 10—10 of FIG. 9, with parts broken away and parts in elevation.

DETAILED DESCRIPTION

Figure 3:
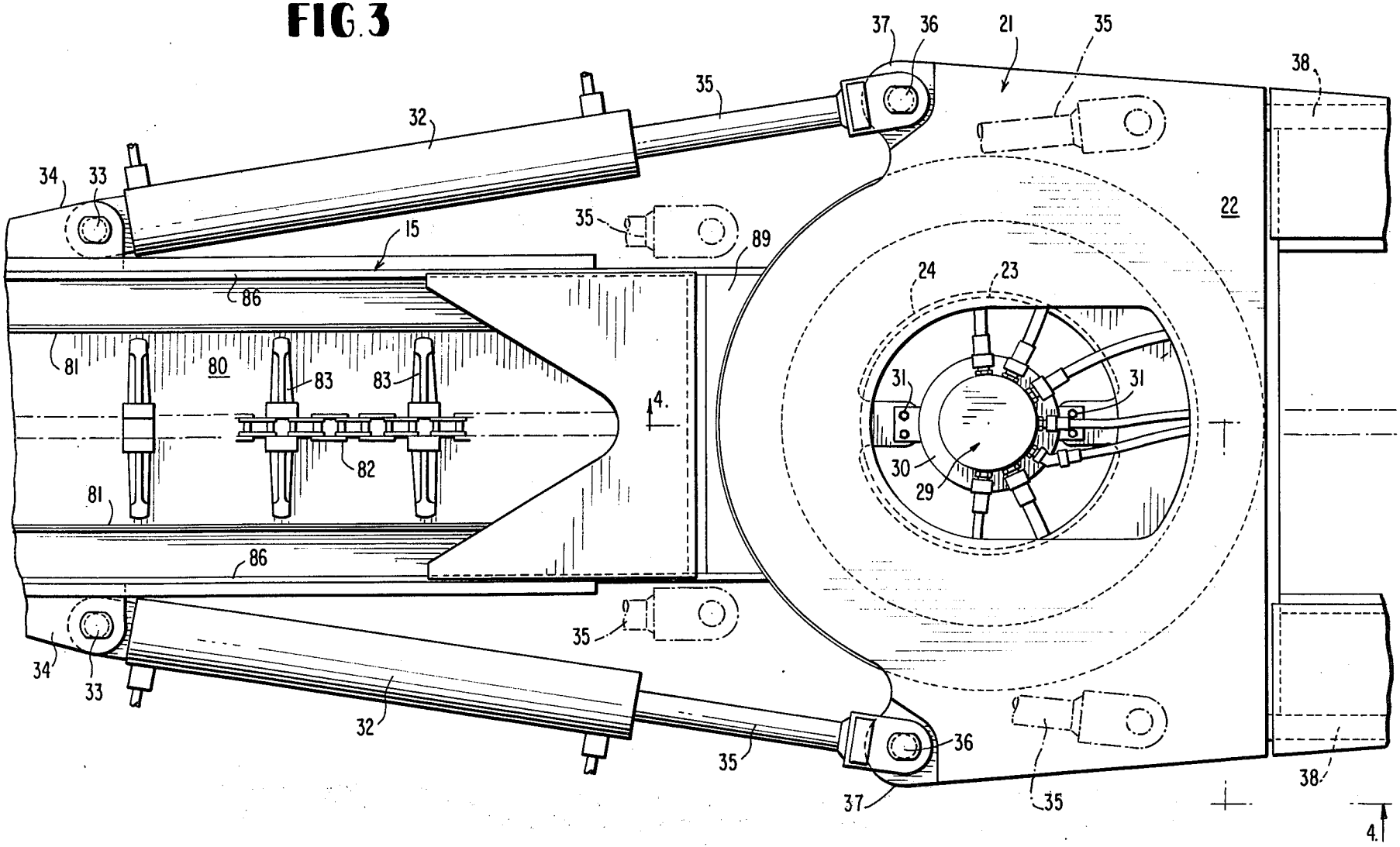
FIG. 3 is an enlarged fragmentary plan view of the machine adjacent to its turret and associated parts.

Referring to the drawings in detail wherein like numerals designate like parts, a low profile mining machine according to the invention comprises a main longitudinal frame 15 or backbone. Crawler track assemblies 16 are conventionally attached to opposite sides of the main frame 15 and are powered by conventional drive means in a rear side compartment 17, also carried by the main frame 15. A machine operator's compartment 18, including an operator's seat 19 and an overhead protection canopy 20, is arranged opposite the compartment 17 in laterally spaced relation, FIG. 2. The operator's compartment is also carried by the main frame 15.

Figures 4, 5:
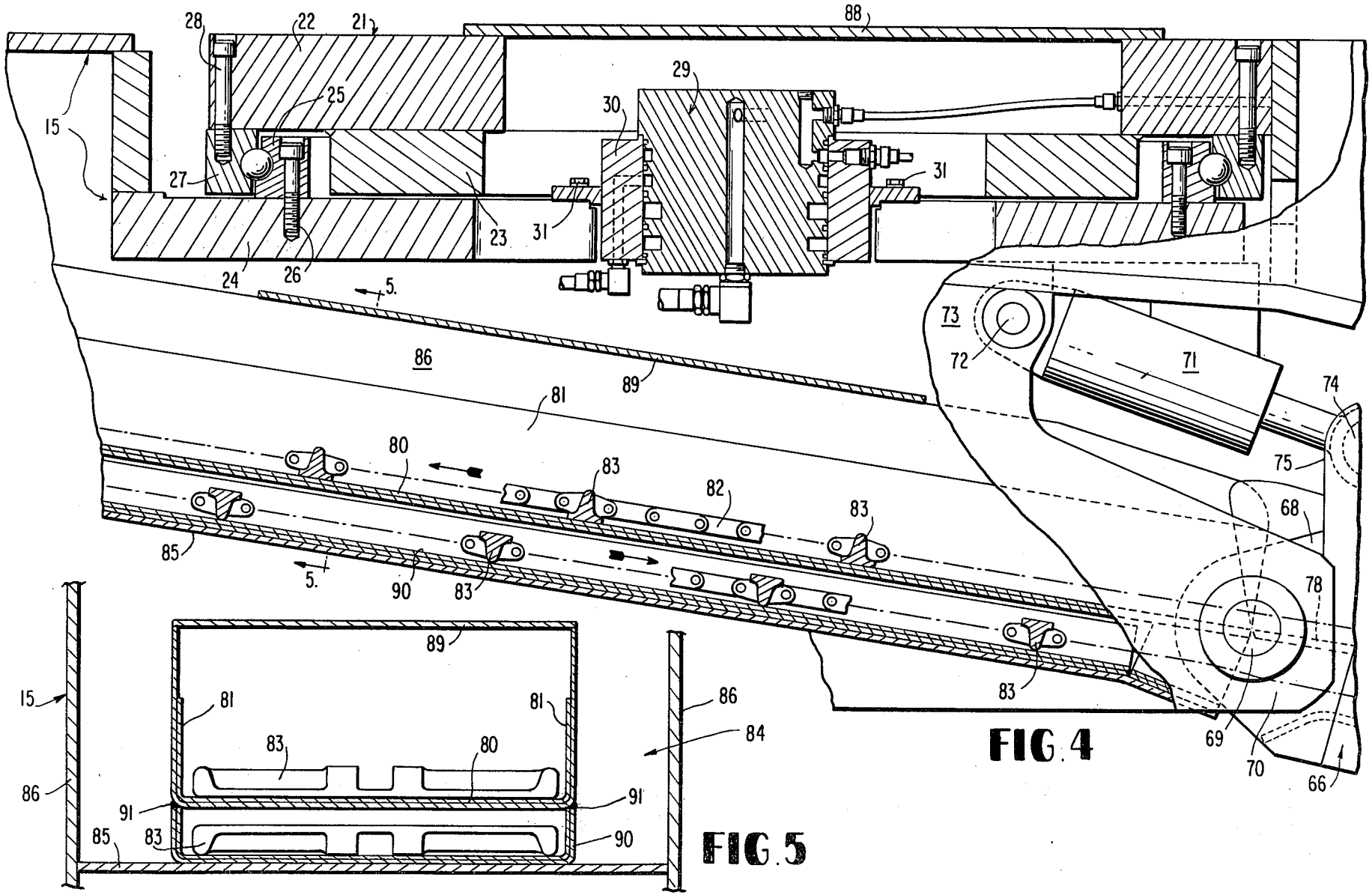
FIG. 4 is an enlarged vertical section taken on line 4—4 of FIG. 3.
FIG. 5 is a transverse section taken on line 5—5 of FIG. 4.

A turntable or turret 21 is mounted on the forward end portion of the frame 15 and the details of this turret are best shown in FIGS. 3 and 4. The turret 21 consists of an upper massive plate or top member 22 which may be approximately five inches thick, with an additional reinforcing plate 23 welded to the bottom thereof, as illustrated in FIG. 4. The reinforcing plate adds approximately three and one-quarter inches of additional thickness to the turret 21 to increase the mass and stability of the mining machine without sacrifice of compactness in a very low profile construction. Beneath the reinforcing plate 23, a depressed heavy plate 24 forming a part of the main frame 15 is disposed fixedly.

A turret support bearing has its inner race 25 attached by screws 26 to the depressed frame plate 24, while the outer race 27 of the bearing is attached by screws 28 to the rotational turret plate 22. A main fluid distribution gland or head 29 is engaged swively in a stationary distribution collar 30 which is attached at 31 to the depressed frame plate 24. The distribution head 29 rotates with the turret 21 while the collar 30 remains stationary on the main frame of the machine. Suitable conventional fluid passages are formed through the collar 30 and the turret plate 22 to allow distribution through the swiveled head 29 of hydraulic fluid and cooling and spray water for components of the machine forwardly of the main frame 15, as will be further described. The arrangement of the distribution head or gland 29 is conventional and need not be further described. The depressed arrangement of the plate 24 on the main frame 15 shown in FIG. 4 is important to the invention as it allows significant lowering of the turret 21 and thus contributes to the overall low profile for the machine according to the prime objective of the invention.

The turret 21 is swung on the axis of support bearing 25-27 by a pair of swing cylinders 32 having their rear ends pivotally connected as at 33 to lugs 34 carried by opposite sides of main frame 15. The rods 35 of these swing cylinders 32 are similarly attached at 36 to lugs 37 on the opposite sides and rear portion of the turret 21. FIG. 2 shows schematically the swing or sluing range of the turret 21 which is 80 degrees, plus or minus 40 degrees from the longitudinal center line of the machine.

Figure 7:
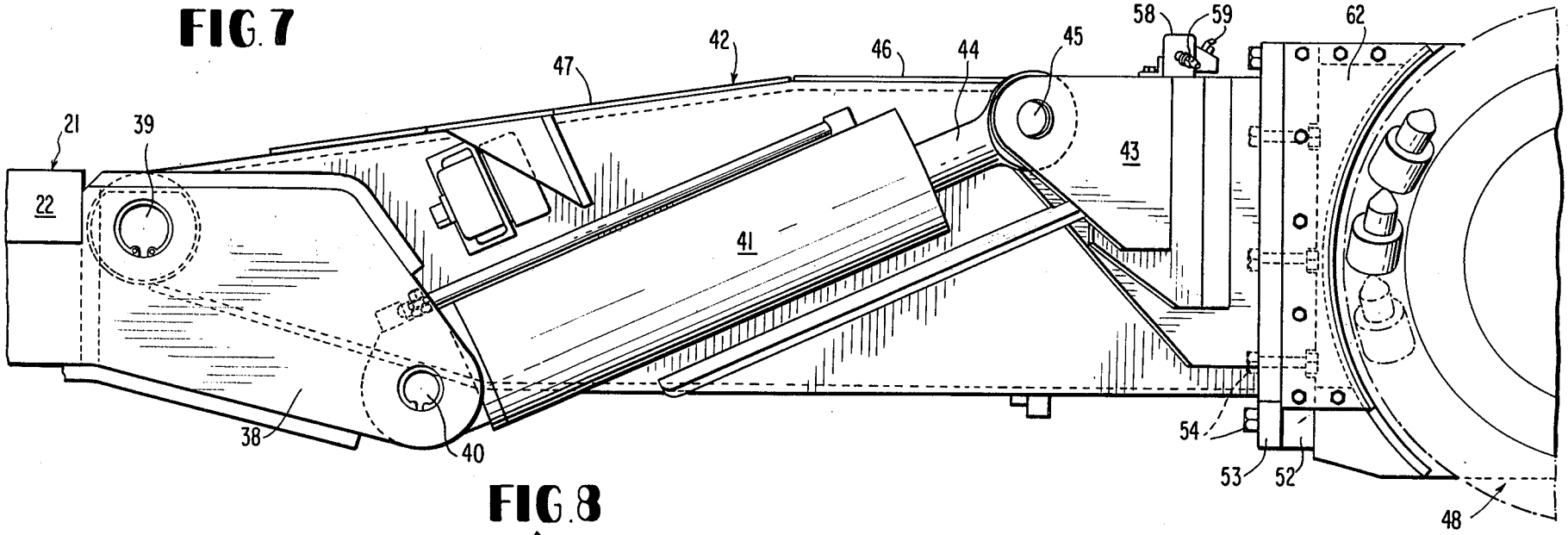
FIG. 7 is a side elevation of the boom portion of the machine shown in FIG. 6.

At its forward end, the turret 21 has widely spaced support knuckles 38 which extend forwardly and downwardly, as clearly shown in FIGS. 1 and 7. This is an important feature, which will be further amplified in the description. The spaced knuckles 38 form cantilevered supports for boom pivot elements 39 and for the supporting pivots 40 of a pair of boom lift cylinders 41 disposed on opposite sides of a vertically swingable boom 42.

Near its forward end, the boom 42 has side lugs 43 to which the rods 44 of the lift or shear cylinders 41 are attached as at 45 by conventional ball type pivot means. These ball pivot elements are employed throughout the machine for the various connections with power cylinders and other pivotal components and are very efficient.

As shown in FIGS. 1 and 7, the boom 42 has angled upper faces 46 and 47 which will be further mentioned in connection with the operation of the machine and its important geometry. At its leading end, the boom 42 is equipped with a ripper type toothed cutting head 48 which is readily interchangeable with a milling type cutter head 49 depicted in FIG. 8. These two types of cutter heads per se are conventional and need not be described in detail. The ripper type head 48 has an internal planetary gear drive 50 which is conventional and driven by a longitudinal input shaft 51. The ripper head 48 includes a head plate 52 demountably secured to a boom forward plate 53 by bolts 54.

Figure 6:
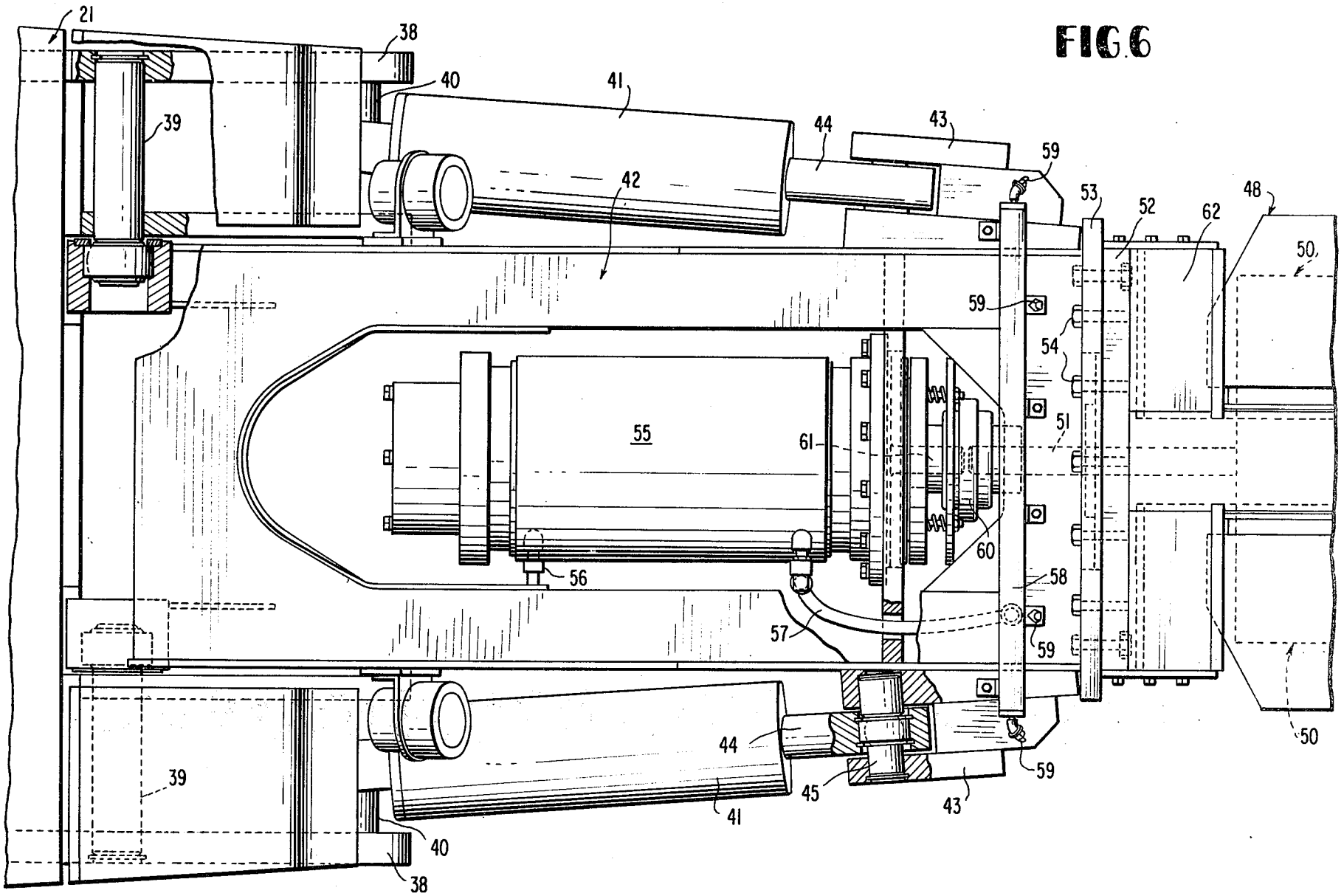
FIG. 6 is a fragmentary plan view of the machine boom and associated components, on a slightly larger scale than FIG. 3.

Within the boom structure, FIG. 6, is a water cooled electric drive motor 55 receiving water from the swiveled distributor head 29 through a hose 56 and discharging the water through another hose 57 leading to a manifold 58 which delivers the same water to a plurality of water spray nozzles 59 near the rear of the ripper head 48 to reduce the dust produced by mining operations.

The input shaft 51 for ripper head 48 is connected by a coupling 60 to a coaxial driven shaft 61 of motor 55. Suitable reduction gearing 62 is intervened between the split planetary gear 50 of the ripper head 48 and the coupling 60. This driving arrangement is conventional.

Figure 8:
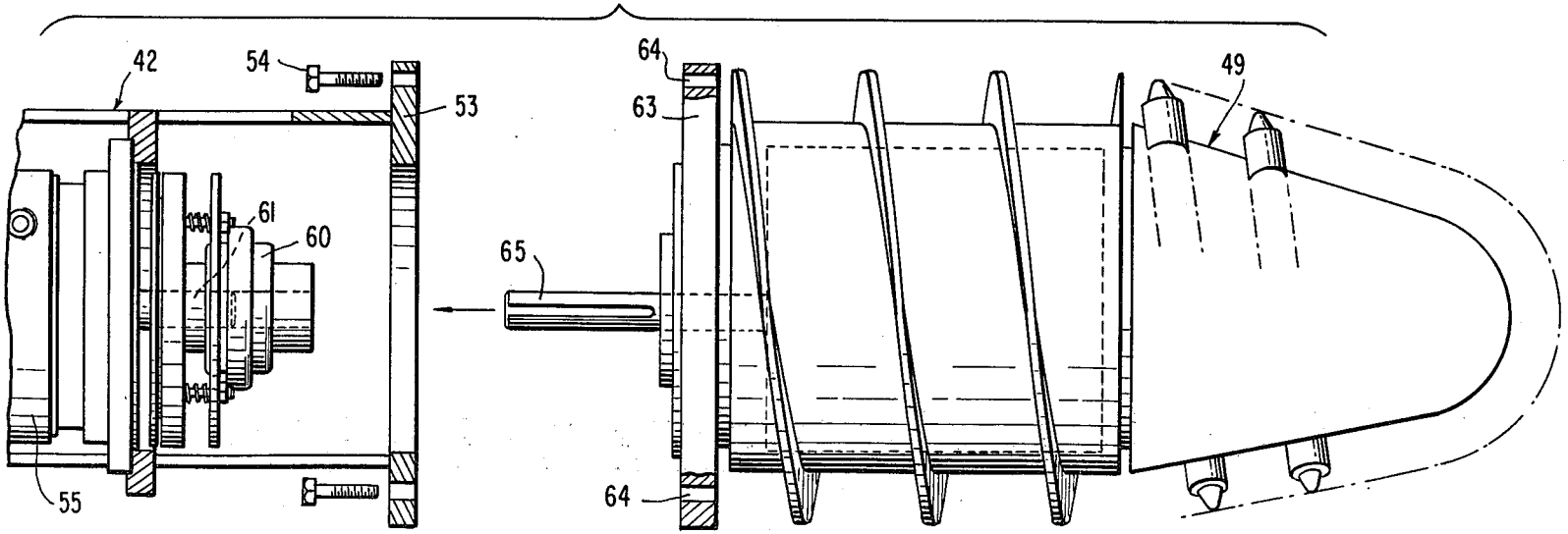
FIG. 8 is an exploded side elevation, partly in section, of a power driven milling head for the machine boom which is interchangeable with a toothed ripping cutter head.

FIG. 8 depicts the arrangement whereby the milling head 49 can replace the ripper head 48 readily on the mining machine. The entire ripping head assembly, including head plate 52, is removable from the boom 42 by releasing the bolts 54, and the milling head 49 has its own head plate 63 with apertures 64 to receive the bolts 54. An input shaft 65 for milling head 49 is connected to the motor shaft 61 through the coupling 60 in the same manner described in connection with the shaft 51 of the ripper head 48.

By virtue of the boom lift cylinders 41 and the geometry of the mechanism, to be further discussed, the boom has a large arc of travel vertically, as shown in FIG. 1, namely sixty degrees above the horizontal and seventeen degrees below it. In the maximum up position, the head 48 can cut approximately twelve feet above grade, while in the maximum down position of the boom the cutter head will reach about eight inches below grade, as illustrated.

The machine additionally comprises a gathering head 66 for mined material and the details of the gathering head are shown particularly in FIGS. 9 and 10. The gathering head is situated below the boom 42, FIG. 1, and forwardly of the track or tread assemblies 16. More particularly, the gathering head 66 which is rectangular as shown in FIG. 10 and forwardly tapered as shown in FIG. 9 has a sloping upper surface 67, whereby the head can pass readily beneath mined solids during forward movement of the machine. At its rear end, the gathering head 66 has laterally spaced knuckles 68 equipped with transverse pivot pins 69 which are received rotatably in bearing extensions 70, on the leading end of main frame 15. Above the pivots 69 and beneath the turret 21, rearwardly of its cantilevered support knuckles 38, are a pair of lift cylinders 71 for the gathering head 66, whose rear ends are pivotally attached at 72 to a top leading portion 73 of the main frame 15 rearwardly of the bearing extensions 70. The forwardly extending rods of cylinders 71 are attached at 74 to upstanding lugs 75 on the rear of gathering head 66. By means of the cylinders 71, the gathering head may be swung vertically or adjusted on the axes of pivot pins 69, as required.

The gathering head 66 has a central mined material receiving opening 76 into which rotating gathering arms 77 continually feed the mined material as it is scooped up on the inclined face 67. Within the material opening 76 below the plane of the surface 67, a stationary somewhat inclined plate 78 receives material gathered by the arms 77. Side walls 79 rise from the plate 78 forming therewith a channel passage for the gathered material longitudinally of the gathering head 66 and this passage communicates with a longer rearwardly extending pan or plate 80 having channel forming side walls 81 which continues upwardly and rearwardly for the length of the mining machine, as shown in FIGS. 1 and 2.

Associated with the plate 78 and long pan 80 is a conveyor chain 82 whose top and bottom runs travel in the direction of the arrows, FIG. 9, above and below the elements 78 and 80. A multiplicity of spaced transversely extending flight bars 83 attached to the chain 82 propel the mined material rearwardly and longitudinally from the gathering head 66 to the rear end of the mining machine along the path shown in dotted lines in FIG. 1. Rearwardly of the machine, the material is discharged from the pan 80 into cars or onto a belt conveyor for movement out of the mine. As best shown in FIG. 5, the inclined pan 80 and its channel forming side walls 81 are located inside a larger channel passage 84 formed by the bottom wall 85 and side walls 86 of main longitudinal frame 15.

It may be noted in FIG. 9, as well as in FIG. 4, that the meeting ends of plate 78 and pan 80 lie on the axis of pivot elements 69. These meeting ends are also shown at 87 in FIG. 10. This arrangement assures that no gap is developed between the elements 78 and 80 in any adjusted angle of the gathering head 66 under influence of its lift cylinders 71 and assures that the mined material can flow without spillage from the gathering head to the rear discharge end of the machine. Removable safety cover plates 88 and 89 or cowlings are provided throughout the machine, as is common practice.

As best shown in FIG. 5, the lower return run of conveyor chain 82 with its flights 83 passes through a lower guide channel 90 immediately above the wall 85 and the top of the channel 90 is welded as at 91 to the bottom of the overlying channel formed by elements 80 and 81.

The conveyor chain 82 is powered by a sprocket gear 92 within the gathering head 66 immediately ahead of the plate 78 and the sprocket gear is driven by splined shaft ends 93 connected with splined couplings 94 which in turn are driven by transverse splined output shafts 95 of laterally opposed bevel gear drives in opposite sides of the gathering head 66, which drives are conventional. Each such drive includes a motor 96, the motors being synchronized and having their shafts coupled at 97 with input shafts of the two-mentioned bevel gear drives at right angles to the shafts 95. Additionally, the two drives include vertical axis disc cranks 98 which are flush with the surface 67 of the gathering heads. The gathering arms 77 have intermediate hubs 99 which orbit in circular paths 100 with the two discs 98 in out of phase relationship, the two gathering arms 77 lying close to the top surface 67 of the gathering head. The gathering arms 77 are pivoted through elbow hubs 101 with short arm extensions 102 which in turn are pivotally secured at 103 to the gathering head 66 near the rear thereof on opposite sides of the material opening 76. The operation of the gathering arms 77 is conventional and need not be further described. It should now be clear that the synchronized drive motors 96 not only drive the gathering arms 77 but also drive the conveyor chain 82 through the splined output shafts 95.

It may be mentioned that the passages between the frame walls 86 and channel 90, FIG. 5, are utilized for retaining various hydraulic hoses so that the latter will not flap about.

As mentioned previously, the most important feature of the invention over the prior art is its compactness and more particularly its extremely low elevation enabling the machine to move into and through mines without disassembling it and reassembling as is frequently required in the prior art. In achieving a low profile, certain geometrical relationships of key operating components are particularly critical and can be best explained in connection with diagrammatic FIG. 1A.

Referring to FIG. 1A, it will be seen that the total height of the mining machine is restricted to forty-four inches between the top surface of turret 21 and the grade or ground level on which the crawler tracks 16 operate. This forty-four inch height can be further reduced a few inches by employing lower profile crawler tracks in some cases.

The key to minimizing the height between ground and the top of turret 21 resides in depressing or lowering the turret 21 as much as possible through the underslung support structure of FIG. 4 involving the depressed frame plate 24 and the bearing 25-27 mounted thereon and carrying turret 21. However, the key to lowering the turret in this manner resides in certain other geometric arrangement of parts which will now be described in relation to FIG. 1A. A main requirement enabling lowering of the turret 21 is the cantilevered support through the turntable elements 38 of the boom 42 and its lifting devices forwardly of the turntable, and additionally, arranging the boom lifting cylinders 41 entirely above the gathering head 66 and down as near as possible to the gathering head without interfering with the operation of the gathering arms 77 or clogging the throat of the machine which begins at the opening 76 of the gathering head. Still another requirement is to place the pivots 40 of lift cylinders 41 in front of the crawler treads 16 and above the gathering head and further arranging these pivots 40 forwardly of the highest point of the gathering head 66. These are the critical geometric requirements of the machine to achieve the reduced height dimension of forty-four inches between the turret top and ground level.

Again referring to FIG. 1A, the relative locations of the above-noted critical pivot points are shown schematically in relation to each other and in relation to the top surface of turret 21, heightwise, and in relation to the vertical axis of rotation of the turret lengthwise, this vertical axis of rotation is also the axis of the turret bearing 25-27 and the location of this bearing relative to the top of the turret and the several critical pivots is also schematically shown in FIG. 1A. Again, this particular geometry in the machine has proven to be essential to depressing the height of the turret 21, and thus achieving the overall height dimension of forty-four inches, or even less if smaller crawler treads are employed.

Another important geometric feature of this invention not specifically illustrated, FIG. 1A, but inherently present in the mechanism and distinguishing it from the known prior art is the following, with particular reference to FIGS. 1 and 7. In the lowermost position of the boom 42, FIG. 1, a level plane through the forward pivots 45 of boom lift cylinders 41 is above a parallel plane through the rear lift cylinder pivots 40. When the boom is raised to a position for travel through a mine tunnel, that is, to a position where the bottom of the ripper head 48 clears the ground by approximately seven inches and the top of the ripper head 48 is in the plane of the top surface of the turret 21, the forward pivots 45 of boom lift cylinders 41 are in approximately the same horizontal plane in which the boom pivot 39 lies, and actually are in a horizontal plane slightly above and parallel with the horizontal plane that contains the boom pivot 39. Thus, the top of the turret 21, the boom pivot 39, the turret support bearing 25-27, and the boom lift cylinder pivot connection 40 with the turret all lie in closely adjacent parallel planes. The plane of the bearing 25-27 is between the plane of lift cylinder pivot 40 and the plane of the top of the turret; and the plane of boom pivot 39 is between the plane of the bearing 25-27 and the plane of the top of the turret. In the shear movement operating range of the boom 42 and ripper head 48 within the confines of the plane of the top of the turret and the lowermost position of the boom 42 when the ripper head is approximately eight inches below grade, as shown in FIG. 1, the plane of the forward pivot connections 45 of the boom lift cylinders 41 with the boom moves in a range parallel with and between the parallel planes of the boom lift cylinder connections 40 and the top of the turret.

Since the general mode of operation of the mining machine is conventional, there is no necessity for describing the operation herein. The described features and advantages of the invention over the prior art are thought to be readily apparent to those skilled in the art.

The terms and expressions which have been employed herein are used as terms of description and not of limitation, and there is no intention, in the use of such terms and expressions, of excluding any equivalents of the features shown and described or portions thereof but it is recognized that various modifications are possible within the scope of the invention claimed.

I claim:

1. A mining machine comprising a vehicular frame, a vertical axis turret on the vehicular frame whose top surface defines the top of the mining machine above ground level, a depressed bearing support means for the turret on the vehicular frame at an elevation below the top surface of the turret, a mined material gathering head pivotally mounted on the forward end of the vehicular frame at an elevation below said turret, a vertically swingable boom carried by the turret and extending forwardly of the turret and adapted to swing through an arc well above the top surface of the turret and having a forward end cutting head, forward end cantilevered extension means on the turret projecting forwardly thereof and downwardly and disposed above a medial portion of the gathering head, horizontal axis pivot means for said boom on said cantilevered extension means, boom lifting and lowering cylinder means connected with the boom and connected with the cantilevered extension means below and forwardly of said horizontal axis pivot means and above a medial portion of said gathering head, said lifting and lowering cylinder means disposed bodily above said gathering head, and the top surface of said turret, said boom pivot means and the connection of said cylinder means with said cantilevered extension means of the turret lying in closely adjacent substantially horizontal planes.

2. A mining machine as defined in claim 1, and said horizontal axis pivot means for said boom and said connection of said cylinder means with said cantilevered extension means lying above said gathering head and forwardly of treads which support said vehicular frame.

3. A mining machine as defined in claim 2, and said connection being forwardly of the highest portion of said gathering head.

4. A mining machine as defined in claim 1, and said depressed bearing support means for the turret comprising a fixed support plate on the vehicular frame at an elevation substantially below the top of said frame and turret, and a low friction bearing for said turret having one race thereof fixed to said fixed support plate and another race secured to the turret.

5. A mining machine as defined in claim 4, and the turret comprising a top thick plate secured to said another race and a lower attached reinforcing plate disposed between the top plate of the turret and the fixed support plate and lying within the bore of said one bearing race.

6. A mining machine as defined in claim 1, and a vertical axis rotational bearing for said turret on said depressed bearing support means and the plane of said bearing lying between parallel planes through the boom pivot means and the connection of said cylinder means with said cantilevered extension means.

7. A mining machine as defined in claim 1, and a vertical axis rotational bearing for said turret on said depressed bearing support means, and the connection of said cylinder means with said boom when the boom is in a lowermost position relative to said turret is below and in a plane closely adjacent to the plane of said bearing.

8. A mining machine as defined in claim 1, and a vertical axis rotational bearing for said turret on said depressed bearing support means, and the plane of said horizontal axis boom pivot means being disposed between the plane of said bearing and the plane of the top surface of said turret.

9. A mining machine as defined in claim 1, and wherein the shear movement range of said boom and cutting head within the confines of the plane of the top surface of the turret and the lowermost position of the boom with the cutting head somewhat below grade is such that the plane of the connection of said cylinder means with the boom moves in a range between the parallel planes of the top surface of the turret and the connection of the cylinder means with the cantilevered extension means.

10. A mining machine as defined in claim 1, and said boom cutting head comprising a ripper head, rotational power drive means for the ripper head on said boom including a drive coupling means, the ripper head having a driven shaft separably coupled with the drive coupling means.

11. A mining machine as defined in claim 10, including a flanged connection on the leading end of said boom, and a separable milling type cutting head readily interchangeable on said boom with the ripper head, said ripper and milling heads having flanged transmission housings, means separably connecting the selected flanged transmission housing to said flanged connection, and said milling type cutting head having a driven shaft adapted to be separably coupled with the boom drive coupling means.

12. A mining machine as set forth in claim 1, including a pair of boom lifting and lowering cylinder means, each lifting and lowering cylinder means of said pair positioned on opposite sides of said boom, and said pair of lifting and lowering cylinder means connected in converging relation from the cantilevered extension means to said boom.

13. A mining machine comprising a crawler tracked main frame, a vertical axis turret on the main frame near its forward end, a depressed bearing support for the turret on the main frame, bearing means substantially entirely located in a horizontal plane connecting said turret to said bearing support, a mined material gathering head on the main frame forwardly of the crawler tracks thereof, a vertically swingable boom having a powered cutting head pivoted to the turret closely adjacent said bearing means in both vertical and horizontal directions, depending and forwardly extending extensions on the turret above the gathering head, extensible and retractable power cylinders for raising and lowering the boom having pivotal connections fore and aft with the boom and with said turret extensions below the elevation of the boom pivot and the elevation of said bearing means and forwardly thereof, and the elevation of the pivotal connections of the cylinders with said boom being above the pivotal connections of the cylinders with said turret extensions when said boom is in a lowermost position relative to the turret and near and above and substantially parallel with the top surface of said gathering head.

14. A mining machine comprising a vehicular frame, a vertical axis turret on the vehicular frame, a depressed bearing support means for the turret on the vehicular frame at an elevation below the top of the turret, a material gathering head on the forward end of the vehicular frame below the elevation of the turret, a vertically swingable boom carried by the turret, power means to rotate the turret on its vertical axis, power means to raise and lower said vertically swingable boom, power drive means on the boom near its leading end including a drive coupling, a flanged connection on the leading end of the boom, readily interchangeable ripper and milling head flanged transmission housings having heads rotatable relative thereto respectively about an axis transverse to the axis of the boom and about an axis in axial alignment with the axis of the boom, each of said flanged transmission housings having a transmission connected to drive the respective head and an input shaft adapted to be separably coupled to said drive coupling, and means separably connecting the selected flanged transmission housing to said flanged connection.

15. A mining machine comprising a mobile frame, a vertical axis turret comprising a top member, a bearing having one rotatable part thereof fixed to said mobile frame and another rotatable part thereof secured to said top member, said turret having a height substantially comprising the combined heights of said top member and said bearing, a vertical swingable boom having a powered cutting head on the forward end carried by the turret and extending forwardly of said turret, forwardly extending cantilevered extensions on the turret on opposite sides of the boom and projecting downwardly below the plane of said bearing, horizontal axis pivot means for said boom on said cantilevered extensions, boom lifting and lowering cylinder means positioned on opposite sides of said boom and connected between a medial portion of the forwardly extending boom and the cantilevered extensions at positions below and forwardly of said horizontal axis pivot means and said bearing.

16. A mining machine as set forth in claim 15, in which said boom lifting and lowering cylinder means are connected in converging relation from said cantilevered extensions to the medial portion of said boom.

17. A mining machine as set forth in claim 15, including a pair of swing cylinder means connected between the mobile frame and opposite sides of the turret at points rearwardly of the vertical axis of the turret, and said pair of swing cylinder means substantially positioned within the horizontal plane bounded by the top surface of said top member and the bottom of said bearing.

* * * * *